US007013788B1

(12) United States Patent
Williams et al.

(10) Patent No.: US 7,013,788 B1
(45) Date of Patent: Mar. 21, 2006

(54) LAUNCH TUBE WITH ADJUSTABLE PLENUM

(75) Inventors: Michael W. Williams, Portsmouth, RI (US); Nicholas Bitsakis, Seekonk, MA (US); Gary R. Berlam, Concord, MA (US); James A. Lilley, Portsmouth, RI (US); Brenda Brennan MacLeod, Nashua, NH (US)

(73) Assignee: The United States of America represented by the Secretary of the Navy, Washington, DC (US)

( * ) Notice: Subject to any disclaimer, the term of this patent is extended or adjusted under 35 U.S.C. 154(b) by 256 days.

(21) Appl. No.: 10/627,104

(22) Filed: Jul. 24, 2003

(51) Int. Cl.
*F41F 3/07* (2006.01)

(52) U.S. Cl. ..... 89/1.81; 89/1.817; 89/1.818

(58) Field of Classification Search ..... 89/1.816, 89/1.817, 1.818, 1.81
See application file for complete search history.

(56) References Cited

U.S. PATENT DOCUMENTS 2,966,827 A * 1/1961 Harvey ..... 89/1.816
3,745,876 A * 7/1973 Rocha ..... 89/1.7
3,946,638 A * 3/1976 Cobb ..... 89/1.806
4,523,538 A * 6/1985 Hollmann et al. ..... 114/238
6,119,454 A * 9/2000 Valisko ..... 60/293

FOREIGN PATENT DOCUMENTS

JP 2-233998 * 3/1989

* cited by examiner

*Primary Examiner*—Stephen M. Johnson
(74) *Attorney, Agent, or Firm*—James M. Kasischke; Jean-Paul A. Nasser; Michael P. Stanley

(57) ABSTRACT

A launch tube assembly including an aft launch tube portion, a forward launch tube portion, and a transfer sleeve having a first end fixed to and adjacent the forward end of said aft launch tube portion and a second end adjustably receiving the forward launch tube portion. A forward end of the aft launch tube portion faces a rearward end of the forward launch tube portion within the transfer sleeve. An adjustable plenum is present having a volume within the transfer sleeve defined by an adjusted distance between the facing ends of aft and forward launch tube portions. An end cap is pinned to a forward end of the forward launch tube portion, a gas generator housed in the aft launch tube portion, and a countermeasure device is housed in the forward launch tube portion. An adjustably selected volume of the plenum is such that a gas generated by the gas generator will enable propulsion of the countermeasure device at a predetermined acceleration from the forward launch tube portion.

14 Claims, 1 Drawing Sheet

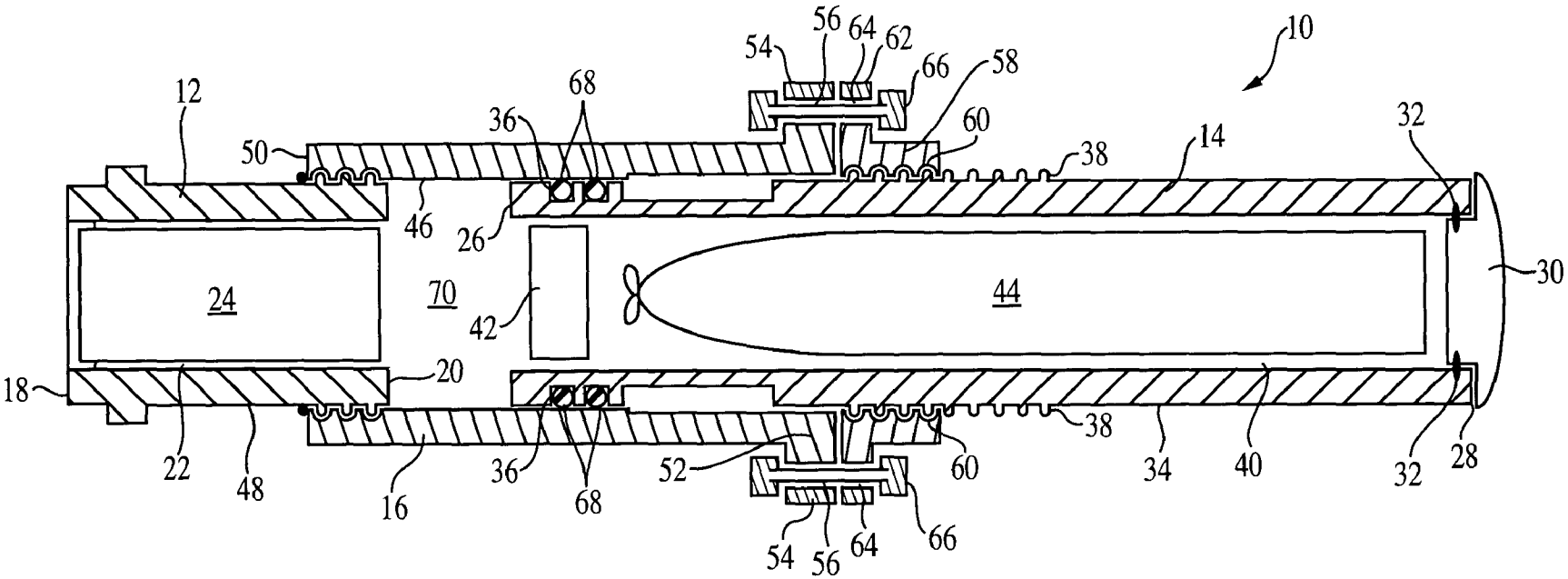
FIG.

LAUNCH TUBE WITH ADJUSTABLE PLENUM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to a launch tube assembly with an adjustable plenum volume.

More particularly, the invention relates to an adjustable length launch tube assembly with an adjustable plenum volume which assures that countermeasures launched from a launch tube have a predetermined acceleration.

(2) Description of the Prior Art

Current externally housed submarine countermeasures are launched by way of gas generators. The generated gas pressure builds up behind the ram plate and countermeasure until there is enough pressure to shear pins holding a muzzle cap in place. This then allows the countermeasure to move through the launch tube and exit. The current gas generator imparts acceleration to the device on the order of 90 g's. A redesign of the gas generator is expected to impart accelerations on the order of 50 g's.

The following patents, for example, disclose gas generation in launch systems, but do not disclose an adjustable length launch tube which in turn creates a predetermined initial plenum volume.

U.S. Pat. No. 5,819,526 to Jackson et al.;
U.S. Pat. No. 5,837,919 to Yagla et al.;
U.S. Pat. No. 5,942,712 to Mello;
U.S. Pat. No. 5,984,635 to Keller;
U.S. Pat. No. 6,044,746 to Gendre et al;
U.S. Pat. No. 6,079,310 to Yagla et al.;
U.S. Pat. No. 6,230,629 to Doctor et al; and
U.S. Pat. No. 5,302,076 to Bredy.

Specifically, Jackson et al. discloses a lower power arcjet propellant feed system for delivering propellant to the low power arcjet. The low power arcjet propellant feed system includes a liquid propellant storage chamber for storing a liquid propellant. A gas generator in communication with the liquid propellant storage chamber generates a gaseous propellant upon receipt of the liquid propellant from the liquid propellant storage chamber. A gas plenum in communication with the gas generator accumulates the gaseous propellant for the gas generator up to a desired pressure. Actively controllable valves actively control the flow of the liquid propellant into the gas generator and actively control the flow of the resultant gaseous propellant out of the gas generator and into the gas plenum up to the desired pressure. A substantially continuous and stable low flow rate of gaseous propellant is then delivered to the low power arcjet.

The patent to Yagla et al. '919 discloses a launcher having means for directing and concentrically spreading, as well as dispersing, exhaust gases created by an internal combustion of an object, such as a missile, that is operatively launchable therefrom. The concentric duct provides the directing, spreading and dispersing means and cooperates with a cup having a means to arrange a port in operative relationship with an exhaust outlet of the object being launched. The cup which mates with the concentric duct has one of its ends open to the ambient so that the exhaust gases are lead into and out of the concentric duct so as to be concentrically dispersed into the atmosphere.

Mello discloses a submarine signal launcher for preventing pinched control wires therein. The submarine signal launcher includes a gas generator, an acoustic device countermeasure, a launch tube for housing the gas generator and the countermeasure, and a ram plate positioned between the gas generator and the countermeasure. A status cable is connected to the countermeasure and intermediately threaded through the ram plate and joined to the gas generator. A collapsible tube is connected to the ram plate and the gas generator. The status cable is confined within the collapsible tube. Securing members are formed on opposing ends of the collapsible tube for securing the collapsible tube to the ram plate and the gas generator, wherein upon assembly of the gas generator with the ram plate and the countermeasure within the launch tube, the collapsible tube will protect the cable from being pinched between joined ends of the ram plate and the gas generator.

Keller discloses a helicopter aircraft with an upper hollow center circular plenum in gaseous communication with a plurality of hollow hinged attached rotor blades. Below the plenum and in gaseous communication with it are two fan jet engines whose gaseous output can be inputted to the plenum and their attached hollow rotor blades through an operator controlled valve system. This same valve system can be adjusted to completely or partially by-pass the plenum and discharge the jet engines' gas to a common rear rudder located on the aircraft to provide directional control to the aircraft when in flight. The plenum is shaped lenticular in cross section similar to an airplane wing to provide a lifting body when the helicopter is in forward flight.

The patent to Gendre et al. discloses a projectile propulsion assembly of the type comprising a chamber housing a pressure source. The chamber which houses the pressure source communicates with at least one pipe placed inside the launch tube and having bores distributed along its length so as to be released in succession during ejection of the projectile.

Yagla et al. '310 discloses a launcher having means for directing and concentrically spreading, as well as dispersing, exhaust gases created by an internal combustion of an object, such as a missile, that is operatively launchable therefrom. The concentric duct provides the directing, spreading and dispersing means and cooperates with a cup having means to arrange a port in operative relationship with an exhaust outlet of the object being launched. The cup which mates with the concentric duct has one of its ends open to the ambient so that the exhaust gases are lead into and out of the concentric duct so as to be concentrically dispersed into the atmosphere.

The patent to Doctor et al. discloses an IR radiating decoy for an IR seeking anti-ship missile (ASM) and includes a propulsion section, safe and arming section, gas generator section, fuel tank section, and flight stabilization section to ignite and continuously maintain an IR plume for decoying the ASM away from the targeted ship. The IR radiating decoy ignites the IR plume immediately when the decoy reaches a safe separation distance from the targeted ship. The IR plume continues to be emitted as the decoy flies away, as it lands on the water, and while it floats upon the water until all the fuel is used from the fuel tank. The fuel can be changed to change the signature of the IR plume so that different ASM missiles can be drawn away from the ship.

Bredy discloses a four stroke combustion engine and method of operation of use and control. The engine includes a combustion chamber with an intake manifold coupled to the combustion chamber. A one-way valve is located within the intake manifold. The engine includes an intake valve for modulating the flow of a fuel-air mixture into and out of the combustion chamber. The engine preferably employs a fixed, late closing intake valve. A plenum chamber is located in the intake manifold. The plenum chamber is located downstream of the one-way valve and upstream of the intake valve. During the compression stroke of the engine, a pressurized charge of the fuel-air mixture is stored within the manifold and plenum. The amount of the fuel-air mixture stored within the plenum is controlled by adjusting the volume of the plenum, or, alternatively, a plenum valve is used to regulate the amount of fuel-air mixture entering/exiting a fixed volume plenum.

It should be understood that the present invention would in fact enhance the functionality of the above patents by providing an adjustable volume plenum that reduces peak acceleration on the countermeasure device being launched from the launch tube assembly.

SUMMARY OF THE INVENTION

Therefore it is an object of this invention to provide a launch tube assembly having a controllable peak acceleration.

A still further object of the invention is to provide a launch tube assembly in which a forward launch tube portion is longitudinally adjustable relative to a sleeve member connected to the aft launch tube portion, by a threaded connection therebetween.

Yet another object of this invention is to provide a launch tube assembly which incorporates existing launch tube structure to adjust a plenum volume suitable for launching a countermeasure device at a predetermined acceleration.

In accordance with one aspect of this invention, there is provided a launch tube assembly including an aft launch tube portion, a forward launch tube portion, and a transfer sleeve having a first end fixed to and adjacent the forward end of said aft launch tube portion and a second end adjustably receiving the forward launch tube portion. A forward end of the aft launch tube portion faces a rearward end of the forward launch tube portion within the transfer sleeve. An adjustable plenum is present having a volume within the transfer sleeve defined by an adjusted distance between the facing ends of aft and forward launch tube portions. An end cap is pinned to a forward end of the forward launch tube portion, a gas generator housed in the aft launch tube portion, and a countermeasure device is housed in the forward launch tube portion. An adjustably selected volume of the plenum is such that a gas generated by the gas generator will enable propulsion of the countermeasure device at a predetermined acceleration from the forward launch tube portion.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

FIG. is a side sectional view of launch tube assembly according to a preferred embodiment of the present invention.

DESCRIPTION OF THE PREFERRED EMBODIMENT

In general, the present invention is directed to an adjustable launch tube assembly as generally shown at 10 in the FIG.

The defining structure of the adjustable launch tube 10 includes an aft launch tube portion 12, a forward launch tube portion 14, and a transfer sleeve 16.

The aft launch tube portion 12 is typically cylindrical in section, and has a closed end 18 and an open end 20. An interior 22 of the aft launch tube portion 12 houses a gas generator 24.

The forward launch tube 14 includes an open end 26 aligned with and facing the open end 20 of the aft launch tube portion 12 and a forward end 28 into which a muzzle cap 30 is secured by a plurality of shear pins 32. An outer surface 34 of the forward launch tube 14 includes recessed grooves 36 adjacent the open end 26 thereof and a threaded portion 38 intermediate the open 26 and forward 28 ends thereof. An interior 40 of the forward launch tube 14 houses a ram plate 42 and a countermeasure device 44, with the countermeasure device 44 abutting the muzzle cap 30.

The transfer sleeve 16 has an inner surface 46 corresponding in dimension to an outer surface 48 of the aft launch tube 12. As previously indicated, it is preferable that the aft launch tube portion 12, forward launch tube portion 14, and transfer sleeve 16 are circular in shape. The transfer sleeve 16 includes a first end 50 fixed to said aft launch tube 12 and a second end 52.

The first end 50 of the transfer sleeve 16 is fixed by welding or the like to the outer surface 48 of the aft launch tube portion 12. The second end 52 of the transfer sleeve 16 includes an outwardly radial flange 54 having plural spaced apertures 56 formed therein and therethrough.

A locking collar 58 includes a threaded inner annular surface 60 and an outwardly radial flange 62 with plural spaced apertures 64 formed therein. The inner surface 60 of the locking collar 58 is threadably engageable with the outer threaded surface 38 of the forward launch tube 14 and faces of the radial flanges 54 and 62 are aligned such that the respective plural apertures 56 and 64 thereof can be aligned. Plural bolts 66 inserted through corresponding ones of the plural aligned apertures 54 and 64 secure the locking collar 58 to the radial flange 62 and to the radial flange 54 of the transfer sleeve 16.

Sealing members 68, such as O-rings, are seated within the recessed grooves 36 on the outer surface 34 of the forward launch tube 14 in order to seal out any hydrostatic pressure between the forward launch tube 14 and the transfer sleeve 16.

As an alternative, it should be noted that the interior surface adjacent the first end 50 of the transfer sleeve 16 may be threaded, and the exterior surface at the forward end 20 of the aft launch tube portion 12 may be threaded as well. The current version is for ease of assembly, and therefore, may be varied.

A plenum 70 is defined in the interior of the transfer sleeve 16 in the location between the open end 20 of the aft launch tube portion 12 and the open end 26 of the forward launch tube portion 14. The plenum 70 volume is selectively adjusted according to the distance into the transfer sleeve 16 that the forward launch tube portion 14 is threaded. The position of the forward launch tube 14 provides a nearly maximum volume to the plenum 70. In other words, if the forward launch tube portion 14 is such that the locking collar 58 is at an inner most end of the threaded portion 38 thereon, then the plenum 70 is at a maximum volume. Likewise, positioning the forward launch tube portion 14 within the transfer sleeve 16 to the point where an outermost end of the threaded portion 38 thereof is engaged with the threaded surface 60 of the locking collar 58 will provide a minimum volume for the plenum 70.

In keeping with the structure described in connection with the FIG., the basic operation of a countermeasure launcher is that an electrical signal (not shown) is sent to the gas generator 24 located within the aft launch tube portion 12 for its activation. As gas is being generated, the volume between the gas generator 24 and the ram plate 42 becomes pressurized to a level where the compressive load being applied to the shear pins 32 which hold the muzzle cap 30 in place, shear, and allow movement of the countermeasure device 44. The continuation of gas generation assures that the pressure behind the ram plate 42 is sufficient to move the countermeasure 44 completely out of the forward launch tube portion 14.

The physical reason for the increased initial plenum volume resulting in lower peak accelerations on the countermeasure 44 can be explained by the following relationships:

$$a_{CM} = \frac{\sum F_{CM}}{m_{CM}} \tag{1}$$

$$\sum F_{CM} \propto P_{plenum} - P_{sea}, \tag{2}$$

where $P_{sea}$ is constant and friction and drag are assumed negligible (in the first 50 msec where peak acceleration occurs).

$$P_{plenum} = \frac{m_{gas}RT}{V_{plenum}}, \tag{3}$$

where $V_{plenum}$ is constant until shear pin failure.

$$\frac{dP_{plenum}}{dt} \propto \frac{1}{V_{plenum}} \cdot \frac{dm}{dt} \tag{4}$$

prior to shear pin failure, assuming R and T constant.

$$P_{plenum}\Big|_{peak} \approx \frac{dP_{plenum}}{dt}\Big|_{t=shear} \Delta t\Big|_{shear}^{peak} + P_{shear}, \tag{5}$$

where Δt to transient peak is a function of the fluid spring system and is not dependent on initial plenum volume.

The relationship shown in equation (4) is a key to the explanation. Since the mass flow rate (dm/dt) entering the plenum at shear pin failure is only slightly lower for a larger initial plenum volume, $V_{plenum}$, dominates. Equation (4) shows that the pressurization rate (dP/dt) of the plenum will be lower for a larger initial plenum volume. Equation (5) shows that the overshoot of the plenum pressure (beyond shear pressure) is proportional to the pressurization rate. Equations (1) and (2) link plenum pressure to countermeasure acceleration. In summary, the larger initial plenum volume reduces the initial pressurization rate, which reduces the plenum pressure overshoot (hence, reduces peak plenum pressure), which reduces peak countermeasure acceleration.

The launch tube 10 with the adjustable plenum 70 is assembled by first welding the aft launch tube portion 12 to the transfer sleeve 16. The forward launch tube portion 14 is then inserted into the transfer piece 16 to the desired length. O-rings 68 inserted in grooves 36 the forward launch tube portion 14 seal the launch tube against hydrostatic pressure. The locking collar 58 is then screwed along the forward launch tube portion 14 until it is both flush against the radial flange 54 at the end of the transfer sleeve 16 and the bolt holes 56, 64 are aligned between the transfer sleeve 16 and the locking collar 58, respectively. Bolts 66 are then secured around the circumference of the mated radial flanges 54, 62 to assure the entire assembly will withstand the loads during the launch event.

A mathematical model of a countermeasure launch is then exercised in order to determine the appropriate plenum volume necessary to achieve the desired peak acceleration on the countermeasure being launched. The volume is then converted into an overall launch tube length, and the forward launch tube portion 14 is moved in or out to achieve the desired length. Note that is was decided to control overall length thread by threading the forward launch tube portion 14 and the transfer sleeve 16 due to the greater linear dimension control. Also, the volume was made adjustable due to the uncertainties of the computer models.

It should also be understood that materials are chosen that can withstand the stresses from a launch impulse.

The present invention will allow current gas generators, that typically impart acceleration peaks on countermeasures of 90-g's to mimic future gas generators that are designed to impart peak accelerations of 50-g's on similar weighted devices.

In view of the above detailed description, it is anticipated that the invention herein will have far reaching applications other than those of a countermeasure launch tube.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A launch tube assembly comprising:

an aft launch tube portion, said aft launch tube portion having a forward open end and a rear closed end for housing a gas generator;

a transfer sleeve having a first end fixed to and adjacent the forward open end of said aft launch tube portion and a second end;

a forward launch tube portion positioned within said transfer sleeve adjacent the second end thereof and selectively adjustable with respect to a longitudinal axis of said transfer sleeve, said forward launch tube portion having a forward end and a rear open end, the rear open end facing the forward open end of said aft launch tube portion, an adjustable plenum being defined as a volume within said transfer sleeve defined by a distance between the forward end of said aft launch tube portion and the rear end of said forward launch tube portion, said forward launch tube portion being provided to house a launch tube device; and an end cap pinned to the forward open end of said forward launch tube portion.

2. The assembly according to claim 1 wherein the first end of said transfer sleeve is fixed to said aft launch tube portion by welding.

3. The assembly according to claim 1 wherein an inner dimension of said transfer sleeve corresponds to an outer dimension of each said aft and forward launch tube portions.

4. The assembly according to claim 1 wherein an adjustably selected volume of said plenum is such that a gas generated by the gas generator will enable propulsion of the launch tube device at a predetermined acceleration from said forward launch tube portion.

5. The assembly according to claim 1 wherein the interior surface of the second end of said transfer sleeve is threaded, and the exterior of the rear end of the forward launch tube portion is threaded.

6. The assembly according to claim 1 further comprising a ram plate slidably positioned in said forward launch tube portion at said rear open end of said forward launch tube portion.

7. A launch tube assembly comprising:

an aft launch tube portion, said aft launch tube portion having a forward open end and a rear closed end for housing a gas generator;

a transfer sleeve having a first end fixed to and adjacent the forward open end of said aft launch tube portion and a second end;

a forward launch tube portion positioned within said transfer sleeve adjacent the second end thereof and selectively adjustable with respect to a longitudinal axis of said transfer sleeve, said forward launch tube portion having a forward end and a rear open end, the rear open end facing the forward open end of said aft launch tube portion, an adjustable plenum being defined as a volume within said transfer sleeve defined by a distance between the forward end of said aft launch tube portion and the rear end of said forward launch tube portion, said forward launch tube portion being provided to house a launch tube device;

an end cap pinned to the forward open end of said forward launch tube portion;

an outward radial flange having plural apertures formed therein at the second end of said transfer sleeve;

a threaded region on a longitudinally intermediate outer surface portion of said forward launch tube portion;

a locking collar having an inner annular threaded surface and an outward radial flange having plural apertures therein, the plural apertures of said transfer sleeve flange aligned with the plural apertures of said locking collar; and plural bolts secureable through respective and aligned ones of said plural apertures of said transfer sleeve and said locking collar.

8. The assembly according to claim 7 further comprising a sealing material positioned between adjacent surfaces of said forward launch tube portion and said transfer sleeve.

9. The assembly according to claim 8 wherein said sealing material is at least one o-ring.

10. The assembly according to claim 8 wherein said sealing material is adjacent the rear end and on an outer peripheral surface of said forward launch tube portion.

11. The assembly according to claim 7 wherein the threaded region of said forward launch tube portion engages with the threaded surface of said locking collar, thereby enabling longitudinal movement of said forward launch tube portion with respect to said aft launch tube portion.

12. A launch tube assembly comprising:

an aft launch tube portion, said aft launch tube portion having a forward open end and a rear closed end;

a transfer sleeve having a first end fixed to and adjacent the forward open end of said aft launch tube portion and a second end;

a forward launch tube portion positioned within said transfer sleeve adjacent the second end thereof and selectively adjustable with respect to a longitudinal axis of said transfer sleeve, said forward launch tube portion having a forward end and a rear open end, the rear open end facing the forward open end of said aft launch tube portion, an adjustable plenum being defined as a volume within said transfer sleeve defined by a distance between the forward end of said aft launch tube portion and the rear end of said forward launch tube portion;

an end cap pinned to the forward end of said forward launch tube portion;

a gas generator positioned within said aft launch tube portion at the rear closed end thereof; and a launch tube device housed within said forward launch tube portion between said end cap and the rear open end of said forward launch tube portion.

13. The assembly according to claim 12 further comprising a ram plate slidably positioned in said forward launch tube portion at said rear open end of said forward launch tube portion between said launch tube device and said gas generator.

14. The assembly according to claim 13 wherein:

said transfer sleeve has an outward radial flange having plural apertures formed therein at the second end of said transfer sleeve;

said forward launch tube portion has a threaded region on a longitudinally intermediate outer surface portion of said forward launch tube portion;

said assembly further comprising:

a locking collar having an inner annular threaded surface and an outward radial flange having plural apertures therein, the plural apertures of said transfer sleeve being aligned with the plural apertures of said locking collar, and the inner annular threaded surface being engageable with the threaded region of said forward launch tube portion; and plural bolts secureable through respective and aligned plural apertures of said locking collar and said transfer sleeve.

* * * * *